US005241713A

United States Patent [19]

Wang

[11] Patent Number: 5,241,713

[45] Date of Patent: Sep. 7, 1993

[54] REINFORCING DEVICE FOR BATHTUB

[75] Inventor: Sung-Shun Wang, Tainan Hsien, Taiwan

[73] Assignee: San Ying Industrial Co., Ltd., Tainan Hsien, Taiwan

[21] Appl. No.: 802,187

[22] Filed: Dec. 4, 1991

[51] Int. Cl.[5] ..... A47K 3/02

[52] U.S. Cl. ..... 4/593; 4/594

[58] Field of Search ..... 4/592, 593, 594

[56] References Cited

U.S. PATENT DOCUMENTS

| | | | |
|---|---|---|---|
| 1,679,838 | 8/1928 | McHugh et al. | 4/593 |
| 3,088,124 | 5/1963 | Long | 4/593 |
| 3,561,019 | 2/1971 | Roland | 4/593 |
| 3,934,278 | 1/1976 | Schrock | 4/593 |
| 4,316,294 | 2/1982 | Baldwin | 4/593 X |
| 4,551,869 | 11/1985 | Whitney | 4/592 |

FOREIGN PATENT DOCUMENTS

| | | | |
|---|---|---|---|
| 2076622 | 10/1971 | France | 4/592 |

*Primary Examiner*—Henry J. Recla
*Assistant Examiner*—Robert M. Fetsuga
*Attorney, Agent, or Firm*—Morton J. Rosenberg; David I. Klein

[57] ABSTRACT

A reinforcing device for a bathtub consists of a bathtub body and a reinforcing base. The bathtub body has four feet beneath the bottom of the bathtub body. The reinforcing base has four basic holes corresponding to the four feet of the bathtub body. The four feet of the bathtub body are capable of being, respectively, inserted into the four basic holes of the reinforcing base. Each foot of the bathtub body and each basic hole of the reinforcing base are screwed up by a screw member, by which the reinforcing base is capable of being fastened with the bathtub body so as to increase the bearing strength and the durability of the bathtub body.

3 Claims, 3 Drawing Sheets

REINFORCING DEVICE FOR BATHTUB

BACKGROUND OF THE INVENTION

1. Field of the Invention

This invention relates to a reinforcing device for a bathtub which consists of a bathtub body and a reinforcing base. The reinforcing base is capable of being attached to the bottom of the bathtub body so as to increase the bearing strength and the durability of the bathtub body.

2. Description of the Prior Art

Generally speaking, bathtubs being known and used in general are made of glass fiber or plastic material. As shown in FIG. 4, the known bathtub 3 produced by monoblock casting method includes four feet 31 beneath the bottom of the known bathtub 3, an outlet on the bottom of the known bathtub 3 and an overflow outlet on one side wall of the known bathtub 3. The four feet 31 are, respectively, disposed beneath the four corners of the bottom of the known bathtub 3. A drain tube 34 is connected to the lower end of the outlet 32. An overflow drain tube 36 is in open communication with the overflow outlet 35 and is downwardly connected to the drain tube 34.

There is a space between the known bathtub 3 and the ground so that the bottom of the known bathtub 3 deflects under a person's loading. A person lying in the known bathtub 3 may feel unsafe and possibly the bottom of the known bathtub 3 may fracture under the heavy weight of the person after long-term use. Therefore, in order to bear a heavy weight over an extended period of time prior art bathtubs 3 must be produced with an increased wall thickness. However, in the manufacturing process, a thick bottom of the known bathtub 3 is wasteful in both labor time and material expenditures since a vast amount of time is necessary to allow cooling of a thickened structure prior to being packed and sold in the marketplace.

SUMMARY OF THE INVENTION

Therefore, the principal object of the present invention is to provide a reinforcing device for a bathtub which consists of a bathtub body and a reinforcing base. The reinforcing base is capable of being attached to the bottom of the bathtub body so as to increase the bearing strength and the durability of the bathtub body and to decrease the producer's cost.

According to the preferred embodiment of the present invention having the object, there are apparent advantages described as follows:

1. The reinforcing base having a simple structure is capable of being attached to the bottom of the bathtub body in a short time.

2. The reinforcing base is capable of greatly increasing the bearing strength of the bathtub body.

3. The reinforcing device of the present invention having a thinner bottom of the bathtub body is capable of decreasing the producer's cost.

BRIEF DESCRIPTION OF THE DRAWINGS

The invention will be better understood by reference to the accompanying drawings, wherein.

DESCRIPTION OF THE PREFERRED EMBODIMENTS

Figure 1:
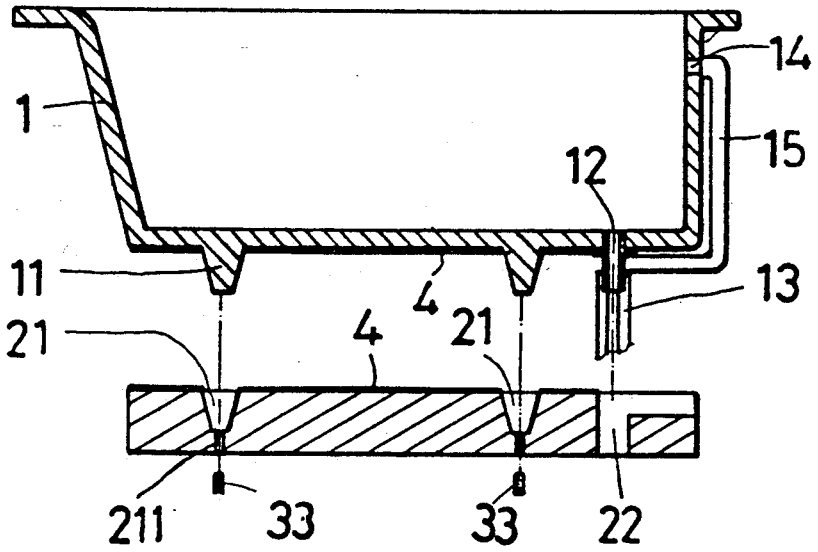
FIG. 1 is a side view showing a preferred embodiment of the present invention in disassembled condition.

As shown in FIG. 1, the present invention is directed to a reinforcing device for a bathtub including a bathtub body 1 and a reinforcing base 2.

The bathtub body 1 with predetermined shape includes four feet 11 beneath the four corners of the bottom of the bathtub body 1, an outlet 12 on the bottom of the bathtub body 1 and an overflow outlet 14 on one side wall of the bathtub body 1. A drain tube 13 is connected to the lower end of the outlet 12. An overflow drain tube 15 is open communication with the overflow outlet 14 and is downwardly connected to the drain tube 13, as shown in FIGS. 1 and 3.

Figure 3:
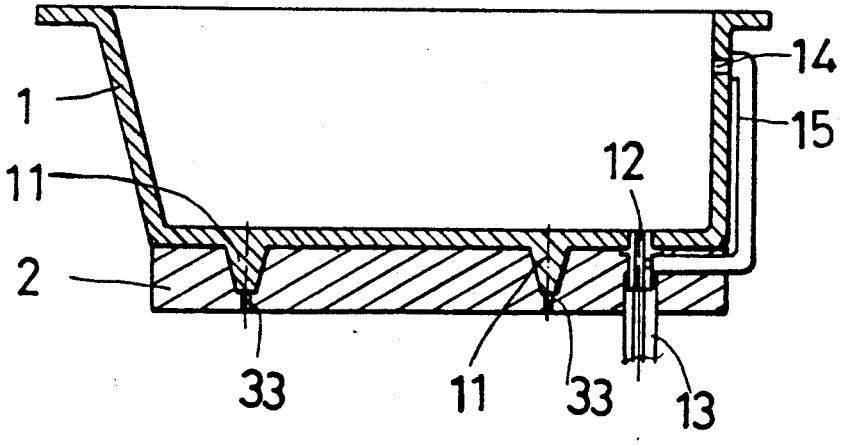
FIG. 3 is a side view showing the preferred embodiment of the present invention in assembled condition.

The reinforcing base 2 includes four basic holes 21 and a through aperture 22, as shown in FIGS. 1 and 3. The four basic holes 21 are disposed correspondingly to the four feet of the bathtub body 1. Each basic hole 21 has a through hole 211 in the center of the basic hole 21. The through aperture 22 disposed correspondingly to the outlet 12 of the bathtub body 1 is capable of being inserted by the drain tube 13 of the bathtub body 1.

Figure 2:
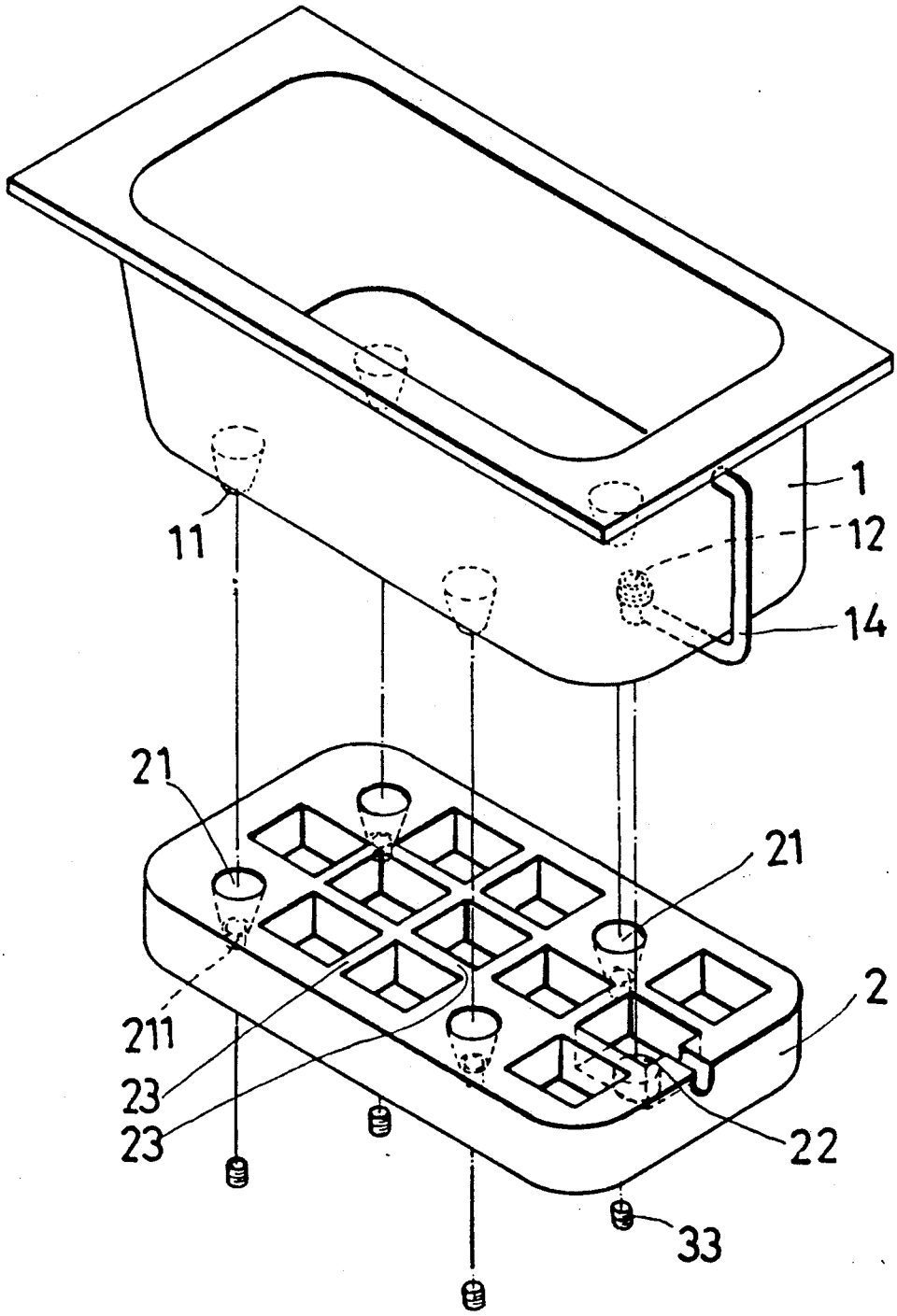
FIG. 2 is a perspective view showing the preferred embodiment of the present invention in disassembled condition.
Figure 4:
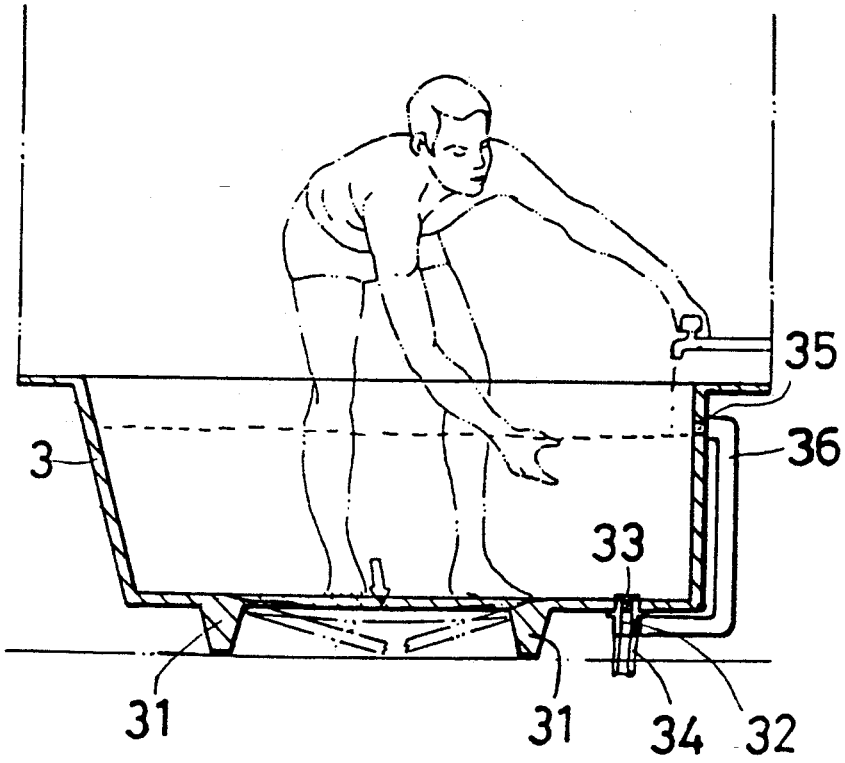
FIG. 4 PRIOR ART
FIG. 4 is a side view showing a known bathtub.

Moreover, besides the four basic holes 21 and the through aperture 22, the reinforcing base 2 is capable of being designed with a plurality of rib recesses formed therein defining a plurality of longitudinal and transverse strengthening ribs 23, as shown in FIG. 2.

In assemblage, insert the four feet 1 of the bathtub body 1 correspondingly into the four basic holes 21 of the reinforcing base 2. Use four screw members 33, respectively, to insert into the through holes 211 of the basic holes 21 of the reinforcing base 2 and upwardly screw up the four screw members 33 into the four feet 11 of the bathtub body 1 so that the bathtub body 1 and the reinforcing base 2 are capable of being firmly fastened together, as shown in FIG. 3.

Moreover, as shown in FIG. 1, the under surface of the bottom of the bathtub body 1 or the upper surface of the reinforcing base 2 is capable of having a layer of adhesive 4 so that the bottom of the bathtub body 1 and the reinforcing base 2 are capable of being fixed together more tightly.

While the preferred embodiments of the invention have been described above, it will be recognized and understood that various modifications may be made therein and the appended claims are intended to cover all such modifications which may fall within the spirit and scope of the invention.

What is claimed is:

1. A reinforcing device for a bathtub comprising:

(a) a bathtub body having a base floor member, a fluid outlet conduit extending through said base floor member and a drain tube coupled to a lower end of said fluid outlet conduit, an overflow drain tube in fluid communication with an overflow outlet opening formed through a sidewall of said bathtub body and further in fluid communication with said drain tube;

(b) a plurality of foot members secured to a lower surface of said bathtub body; and, (c) a reinforcing base member for contiguously interfacing with a substantial portion of said bathtub body lower surface, said reinforcing base member having a plurality of foot member recesses aligned with said foot members for receipt therein of said foot members, said drain tube and said overflow drain tube insertable within an aperture formed within said reinforcing base member, said fluid outlet conduit extending into said aperture and being coupled to said drain tube within said aperture formed in said reinforcing base member, each of said foot members being aligned with a respective opening formed through said reinforcing base member for insert of respective screw members for securement of said bathtub body to said reinforcing base member.

2. The reinforcing device as recited in claim 1 wherein said reinforcing base member is formed having a plurality of longitudinally and transversely extending rib members for interface with said lower surface of said bathtub body.

3. The reinforcing device as recited in claim 1 including an adhesive layer sandwiched between an upper surface of said reinforcing base member and said lower surface of said bathtub body for fixedly securing said bathtub body to said reinforcing base member.

* * * * *